United States Patent [19]

Braybrook et al.

[11] Patent Number: 4,523,441

[45] Date of Patent: Jun. 18, 1985

[54] HANDLING OF TEXTILE YARN

[75] Inventors: George E. Braybrook, Thurmaston; David C. Corby, Cosby; Mark A. Shelton, Leicester; William E. A. Shelton, Oadby, all of England

[73] Assignee: Alan Shelton Limited, Croft, England

[21] Appl. No.: 554,304

[22] Filed: Nov. 22, 1983

[51] Int. Cl.[3] ..... D06B 3/06; D06B 23/04

[52] U.S. Cl. ..... 68/5 C; 28/285; 57/308; 66/125 A; 68/18 F; 68/206; 261/106

[58] Field of Search ..... 68/5 R, 5 B, 5 C, 5 D, 68/5 E, 18 F, 205 R, 205 E, 206; 261/106; 34/26, 32; 28/285; 66/125 A; 57/308

[56] References Cited

U.S. PATENT DOCUMENTS

| | | | |
|---|---|---|---|
| 1,705,212 | 3/1929 | Schwabe | 68/5 C |
| 1,836,531 | 12/1931 | Gere | 28/285 X |
| 1,941,087 | 12/1933 | Hejduk et al. | 68/5 C |
| 2,875,991 | 3/1959 | Ruegsegger | 261/106 X |
| 3,139,462 | 6/1964 | Scott | 261/106 X |
| 4,121,311 | 10/1978 | Meyer | 68/18 F X |
| 4,428,890 | 1/1984 | Harrell | 261/106 X |

FOREIGN PATENT DOCUMENTS

| | | | |
|---|---|---|---|
| 109686 | 9/1917 | United Kingdom | 28/285 |

*Primary Examiner*—Philip R. Coe

*Attorney, Agent, or Firm*—Charles A. Brown; Charles E. Brown

[57] ABSTRACT

The invention relates to a yarn handling arrangement in which the yarn is subjected to conditioning in a humid atmosphere before and as it is drawn off for use in a textile machine. The apparatus described in an example consists of an enclosure comprising a housing, in one compartment whereof are a plurality of pairs of bobbins on support rods, another compartment being defined by a sleeve member which is kept constantly moist by a water distributing device. A flow of air is arranged to fill the sleeve member and to escape therefrom through slots provided at levels corresponding to each of the levels at which the bobbins are supported.

7 Claims, 8 Drawing Figures

HANDLING OF TEXTILE YARN

BACKGROUND OF THE INVENTION

The invention is concerned with improvements in or relating to the handling of textile yarn, particularly the control of humidity in the conditioning of yarns during a textile manufacturing process, for example in respect of the reduction or regulation of the production of loose fly or lint from the yarn.

In the supply of yarn to a textile machine it is customary, for example to mount a plurality of yarn bobbins upon support members in a creel arrangement, yarn drawn off from the bobbins travelling through yarn guides, feed devices, tensioners, stop motions and the like before it is used by the textile machine.

During this travel, loose fibres are inclined to fall away from the main fibres of the yarn, for instance when they pass over contact points such as the yarn guides and the like mentioned above. These loose fibres are known as 'lint' or 'fly'.

Several problems are caused by lint. For example, lint often accumulates in a yarn guide and tends to block the passage. This may break the yarn either at a position remote from the operational zone of the machine when the yarn detection system will stop the machine, or on the zone itself when a fault in the fabric may be caused. Occasionally, lumps of lint may be taken into the fabric, which will produce faulty fabric, and also may cause damage to the fabric-producing elements (such as needle in a knitting machine). Lint floating in the atmosphere in a work room is a health hazard, and any lint which settles in the work room, particularly in the roof structure, may be a fire hazard. Not least of the problems caused is the risk that lint from a coloured yarn may contaminate adjacent yarn or fabric and result in sub-standard goods.

Many attempts have been made to overcome some of the foregoing problems, mainly consisting of systems to blow the lint away from the contact point in the yarn path which may assist in solving the difficulties associated with the fabric and the machine but does nothing for the hazard problems and indeed may even worsen them.

In U.K. Pat. No. 2087543 there is described enclosure means for the control of loose lint or fly released by textile yarns during travel between stations in a textile manufacturing process, comprising a housing, divided into a plurality of interconnected compartments, at least one of which is traversed by a yarn during its travel, means to circulate air in a continuous path through the compartments, a partition being provided between two adjacent compartments comprising a filter screen capable of trapping fly or lint carried by air passing therethrough.

In most textile manufacturing processes, the yarn travel is rapid and therefore because of the shortness of the time during which the yarn is present in the compartments, it is advantageous under many circumstances to establish a high level of humidity within the housing. The effect of this has been to reduce to a minimum the effect of static electricity upon the yarn thus removing a major contributory cause of the lint problem. At the same time, the moisture is partially absorbed into the cell structure of the yarn fibres in a manner similar to that of the conditioning of yarn in storage cabinets, but in a fraction of the time. Thus the yarn is strengthened as compared with yarn taken from creels in a conventional arrangement, and the performance of the knitting process is thus improved.

SUMMARY OF THE INVENTION

The invention provides apparatus for the introduction of humidity to a flow of air impinging upon a textile yarn wound upon or being unwound from a bobbin supported within a humid atmosphere upon support rods for travel of the yarn between stations in a textile manufacturing process, comprising a sleeve member of fabric adapted to provide a passageway for a portion of the path of said flow of air, and a water supply means adapted to supply water to the fabric of the sleeve member to maintain said fabric in a moist condition despite evaporation therefrom into said flow of air.

Advantageously, means are provided to monitor the supply of water to the sleeve member, so as to permit appropriate adjustment of the rate of supply should the fabric become too moist or too dry.

It will be appreciated that in using the invention it becomes possible to begin conditioning the yarn within an enclosure means even before it starts to be unwound from the bobbin.

As mentioned above, groups of yarn bobbins may be mounted upon support members of a creel. Conveniently, the bobbins may be mounted in pairs so that yarn is drawn from a first bobbin of the pair while the second is held in reserve. The changeover from the first to the second bobbin is accomplished by joining the final end of the yarn on the bobbin to the leading end of the yarn on the second bobbin. Lint is found to accumulate at the join in the yarn and in particular on the reserve bobbin. This lint is then liable eventually to be carried forward on the yarn, to cause probable contamination of the various delicate mechanisms and may even be carried through to the end point of the manufacturing step to become incorporated into the fabric, causing faults therein.

Thus the support rods for each pair of bobbins are arranged in pairs which are superimposed to form a plurality of side-by-side columns, the rods being arranged so that axial centre-lines of each of a pair of bobbins converge at a single yarn-receiving point, and so that a columnar space is formed between a bobbin of one pair of bobbins and a bobbin of an adjacent pair of bobbins.

Advantageously, the sleeve member may be arranged so as at least partially to occupy the columnar space and may be provided with apertures in the walls thereof, each of said apertures being located at least substantially adjacent to an appropriate one of the bobbins. Air supply means provide air under pressure to a chamber at least partially defined by an inner surface of the sleeve walls so that it is forced through the apertures in the sleeve member walls to impinge upon the bobbin.

In such an arrangement, it is preferable for the sleeve member to be triangular, or substantially so, in cross section, having three conjoined walls, the conjoined region of two walls projecting into and substantially occupying the columnar space.

Conveniently, the sleeve member may comprise a framework, on which the fabric of the sleeve member may be supported. It will be found paricularly advantageous if the fabric is a moisture retaining fabric in which the apertures are formed as slots cut at levels corresponding to the heightwise position of each pair of bobbins.

BRIEF DESCRIPTION OF DRAWINGS

There will now be described an example of apparatus according to the invention. It will be understood that the description, which is to be read with reference to the drawings, is given by way of example only and not by way of limitation.

DETAILED DESCRIPTION OF DRAWINGS

Figure 1:
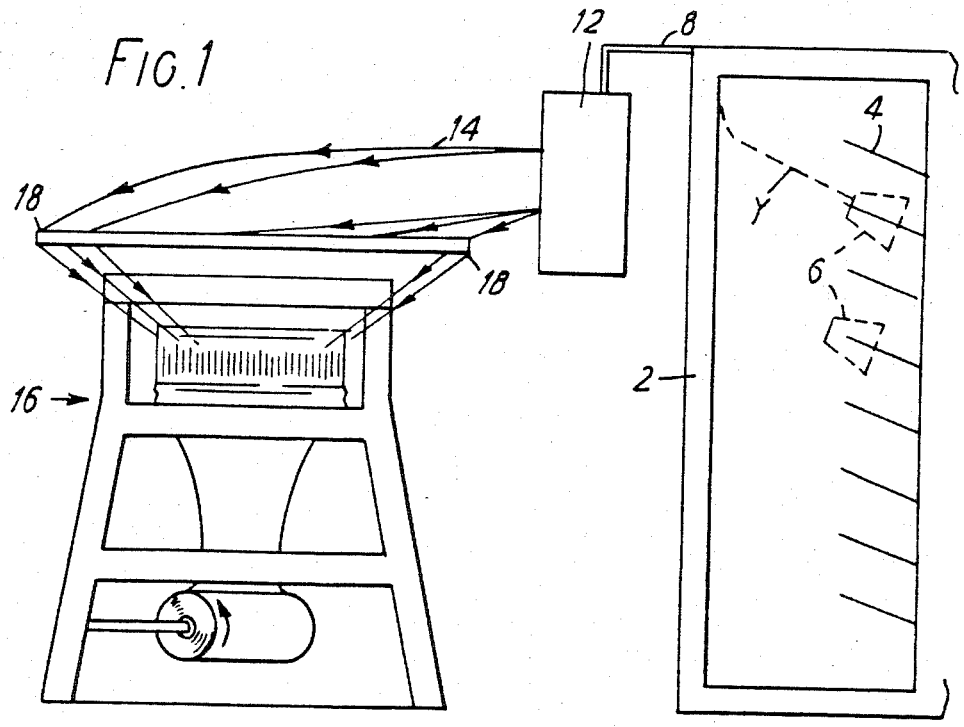
FIG. 1 shows a diagrammatic side view of an arrangement in which the apparatus according to the invention is used in the examples.
Figure 2:
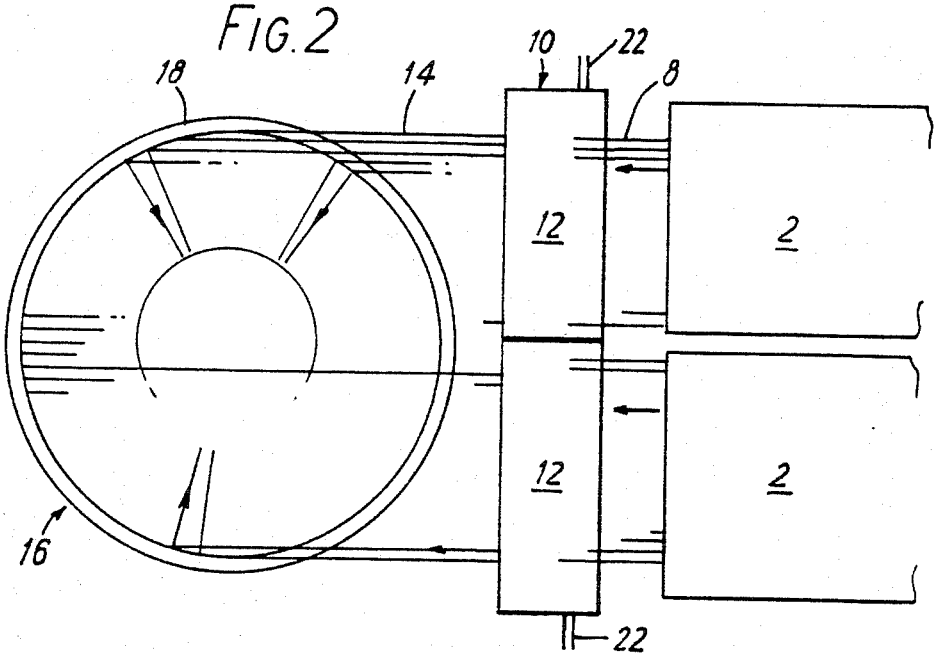
FIG. 2 is a plan view of the arrangement of FIG. 1.

An example of an enclosure is illustrated in the arrangement shown in FIGS. 1 and 2. The arrangement includes a housing 2 having panels entirely enclosing a plurality of bobbin support rods 4 (only a few of which are shown in FIG. 1) upon each of which is supported in use a bobbin of yarn (indicated at 6 in dotted lines). The rods 4 are arranged in pairs in the conventional manner and are arranged to project from a framework of the housing in four columns of nine rows in the present example. Access to each column of bobbins is obtained by providing removable panels which extend the height of the housing.

Each yarn led from the bobbins 4 leaves the housing 2 through a tubular guide means 8 and is guided to cabinet 10 comprising two further enclosures 12, each containing suitable feeding and tensioning devices.

Figure 3:
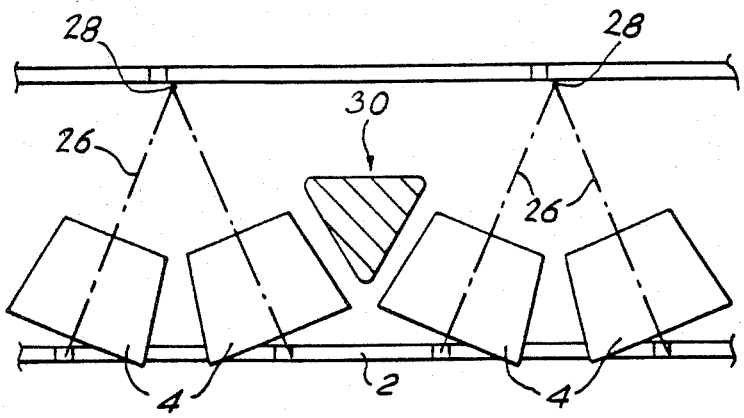
FIG. 3 shows a fragmentary plan view of a creel supporting pairs of bobbins in columns, and indicating a columnar space.

Each yarn, having traversed its associated yarn feeder device 20 then leaves the housing 12 through individual tubular guide means 14 to a circular knitting machine (indicated at 16) having in the present example seventy two feed stations arranged upon a circular framework 18, and thence to the operating region of the needles (not shown). FIG. 3 shows a portion of the housing 2 enclosure a plurality of pairs of bobbins 4 of which only two top pairs are visible in the FIGURE. The centre line 26 of each bobbin in a pair converge on a yarn guide 28 through which yarn passes as it is drawn from the bobbin. As one bobbin is exhausted, so the drawing action is transferred to the second bobbin of each pair since the final end of the first bobbin yarn is tied to the leading end of the second bobbin yarn in a conventional manner. It will be observed that the above described arrangement provides a columnar space indicated at 30 in FIG. 3 and shown as triangular in cross section.

Figure 4:
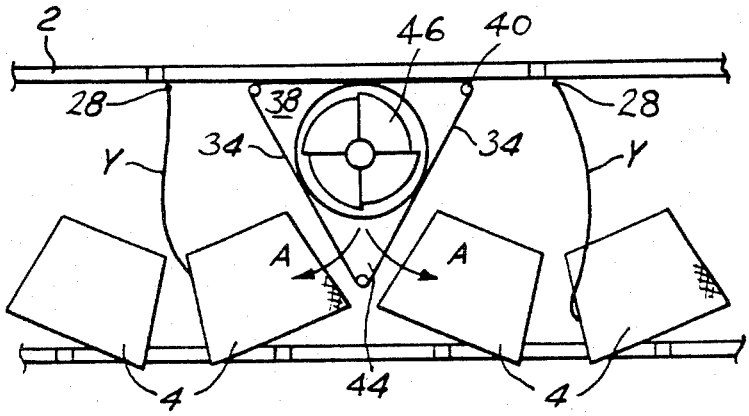
FIG. 4 shows apparatus according to the invention in position in the columnar space of FIG. 3.
Figure 5:
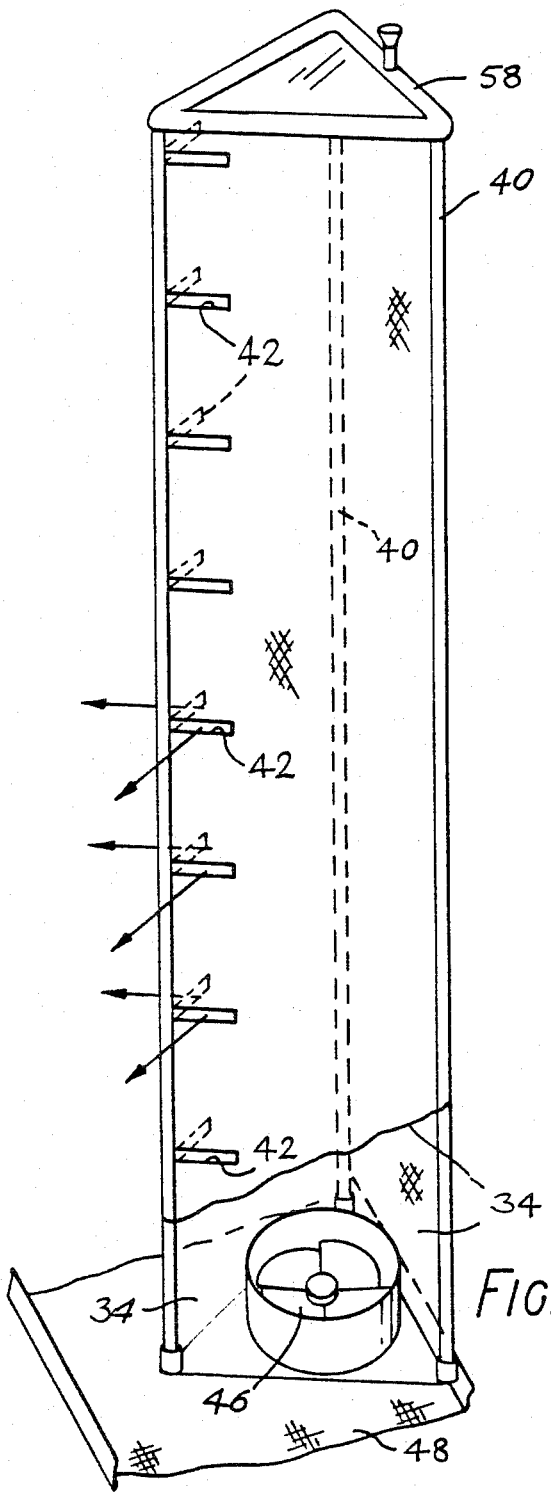
FIG. 5 is a perspective view of a portion of an apparatus according to the invention.
Figure 6:
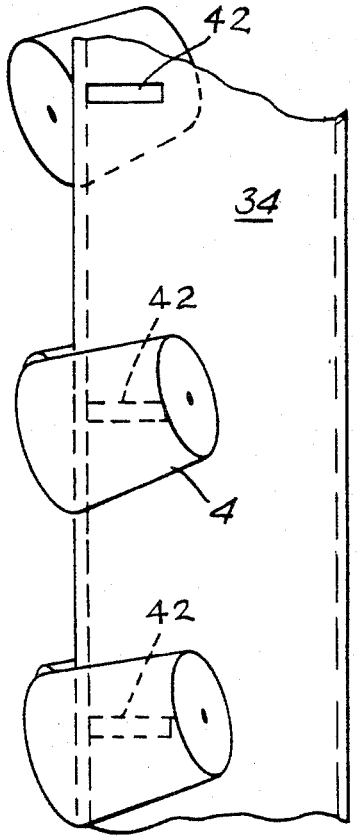
FIG. 6 is a side view illustrating the relative position of parts of the arrangement shown in FIG. 5.

FIG. 4 shows the arrangement of FIG. 3 with the inclusion of a sleeve structure enclosing a chamber 38 defined by walls 34 which are formed from moisture-retaining fabric material supported upon a framework 40 and provided with slots 42 in a region 44 at which two walls are conjoined, this region projecting into the columnar space 30 of FIG. 3. The slots 42 are arranged so that when air from a blower 46 situated beneath the open lower end of the structure 42 fills the chamber 38, a jet of air issues from each slot (see arrows) and impinges directly upon the bobbin immediately adjacent to that slot (see FIG. 6). However, the force of air flow is sufficient to cause its benefit to extend at least to the next bobbin of each pair causing sufficient air turbulence to minimize the adherence of lint to the yarn Y drawn off from the operative bobbins.

Figure 8:
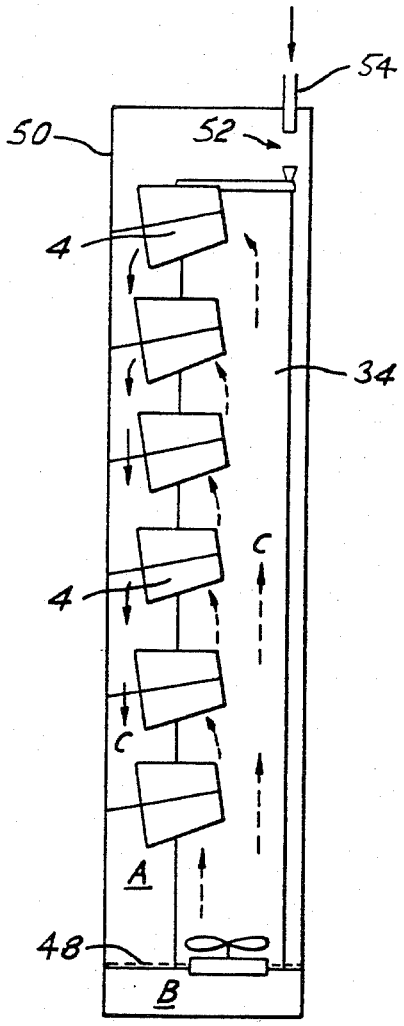
FIG. 8 is a diagrammatic side view of the apparatus showing its general layout.

The arrangement described above is supported within a housing 50 comprising a creel cabinet (see FIG. 8). The interior of the housing is divided into two compartments A and B, by means of a lint filter screen 48.

Air is circulated within the housing 50 in a path indicated by arrows C by means of the fan 46. Lint released by the yarn as it is pulled from the bobbin is carried by the air flow so that it is entrained in the filter screen 48 of the partition.

The sleeve 34, which is made of moisture-retaining knitted cotton fabric in the present example, is secured at its upper end to a water-distributing device 52 in the upper portion of the housing. The fabric of the sleeve 34 is thus maintained in a moist condition, by means to be described below, and air passing upwardly through the sleeve is caused to entrain moisture which is then distributed about the yarn bobbins.

Figure 7:
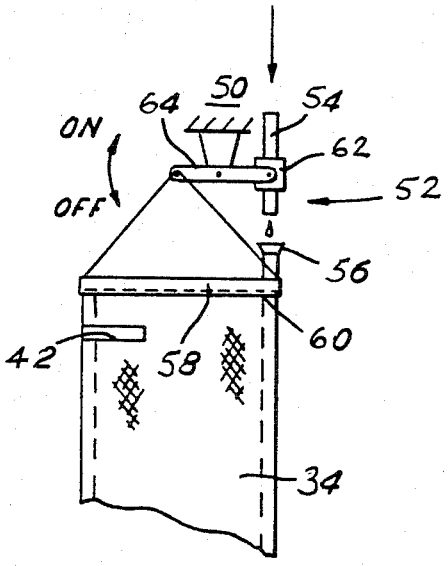
FIG. 7 shows a detail of the water distributing device of the apparatus.

The means whereby the sleeve fabric is maintained in a moistened condition will now be described. Water is supplied through a pipe 54 from which droplets are received in a funnel 56 communicating with the hollow interior of the water distributing device which comprises a perforated tube 58 formed into a triangular platform. Water seeping from the perforations 60 thus travels downwardly through the fabric of the sleeve 34 from which it evaporates into the upwardly and outwardly directed air flow. The degree of partial-saturation of the fabric may be regulated by the arrangement illustrated in FIG. 7 in which the pipe 54 is provided with a valve 62 to regulate the water entering the tube 58. The valve is operated by means of a spring-loaded, two-armed lever 64 mounted upon the housing, a free arm of which supports the weight of the pipe 54 and the fabric sleeve. When the fabric is saturated the weight thereof will maintain the valve in the OFF position, but when the evaporation rate is greater than the rate of supply of water, the weight of the sleeve will be reduced until the lever is permitted to move to the ON position in which further water is drip-fed until the weight of the sleeve has increased sufficiently.

We claim:

1. Yarn handling apparatus comprising a plurality of bobbin support rods with a yarn bobbin mounted upon each bobbin support rod, each yarn bobbin having an axial center line and yarn wound thereabout, enclosure means surrounding the plurality of bobbin support rods, means defining an air flow path through the enclosure means for directing air flowing along said air flow path to impinge on the yarn of said bobbins, means for introducing humidity into said air flow path so that the yarn being wound on said bobbins and being unwound therefrom is subjected to humidified air flow, said humidity introducing means including a sleeve member of fabric for providing a passageway for a portion of the air flow path, and water supply means supplying water to the fabric of the sleeve member to maintain the fabric in a moist condition despite evaporation therefrom into the air flowing along the air flow path, said bobbin support rods being mounted in pairs, said pairs of bobbin support rods being superimposed to form a number of side-by-side columns, said pair of bobbin support rods being arranged so that the axial center line of each bobbin of the apir of bobbins converges at a single yarn-receiving point, and so that a columnar space is formed between a bobbin of one pair of bobbins and a bobbin of an adjacent pair of bobbins, wherein the sleeve member is arranged so as to at least partially occupy said columnar space, said sleeve member having apertures therein, each of said apertures being located at least substantially adjacent to an appropriate one of said bobbins, and air supply means for providing air under pressure to the interior of the sleeve member so that air is forced through the apertures therein to impinge upon the bobbins.

2. Apparatus as claimed in claim 1, wherein there is provided means to monitor the supply of water to the sleeve member, so as to permit appropriate adjustment of the rate of supply should the fabric become too moist or too dry.

3. Apparatus as claimed in claim 1, wherein the sleeve member comprises a framework on which the fabric of the sleeve member is supported, and having said fabric being a moisture retaining material, slots formed therein at levels corresponding to the heightwise positions of each pair of bobbins.

4. Apparatus as claimed in claim 1, wherein the enclosure means comprises a housing internally divided into three compartments by means of a lint filter screen cooperating with the sleeve member, the air flow following a path which in a first of said compartments passes longitudinally through the sleeve member and in a second of said compartments travels over and past the bobbins on the support rods.

5. Apparatus as claimed in claim 1 wherein the sleeve member having opposed ends is secured at one of its ends to a water distributing device to maintain the sleeve fabric in a moist condition.

6. Apparatus as claimed in claim 1 wherein in order to maintain the sleeve fabric in a moist condition, the sleeve member having opposed ends is secured at one of its ends to a water distributing device provided with flow control means responsive to increase or decrease in the weight of the sleeve member according to whether it is over-moist or dry.

7. Yarn handling apparatus comprising a plurality of bobbin support rods with a yarn bobbin mounted upon each bobbin support rod, each yarn bobbin having an axial center line and yarn wound thereabout, enclosure means surrounding the plurality of bobbin support rods, means defining an air flowpath through the enclosure means for directing air flowing along said air flow path to impinge on the yarn of said bobbins, means for introducing humidity into said air flow path so that yarn being wound on said bobbins and being unwound therefrom is subjected to humidified air flow, said humidity introducing means including a sleeve member of fabric for providing a passageway for a portion of the air flow path, and water supply means supplying water to the fabric of the sleeve member to maintain the fabric in a moist condition despite evaporation therefrom into the air flowing along the air flow path, said bobbin support rods being mounted in pairs, said pairs of bobbin support rods being superimposed to form a number of side-by-side columns, said pair of bobbin support rods being arranged so that the axial center line of each bobbin of the pair of bobbins converges at a single yarn-receiving point, and so that a columnar space is formed between a bobbin of one pair of bobbins and a bobbin of an adjacent pair of bobbins, wherein the sleeve member is arranged as to at least partially occupy said columnar space, said sleeve member having apertures therein, each of said apertures being located at least substantially adjacent to an appropriate one of said bobbins, and air supply means for providing air under pressure to the interior of the sleeve member so that air is forced through the apertures therein to impinge upon the bobbins, wherein the sleeve member is substantially triangular in cross-section, having three conjoined walls, the conjoined region of two of the conjoined walls projects into and substantially occupies said columnar space.

* * * * *